US005458198A

United States Patent [19]

Hashemi et al.

[11] Patent Number: 5,458,198

[45] Date of Patent: Oct. 17, 1995

[54] METHOD AND APPARATUS FOR OIL OR GAS WELL CLEANING

[75] Inventors: Reza Hashemi, Sea Cliff; Christophe A. Malbrel, New York, both of N.Y.

[73] Assignee: Pall Corporation, East Hills, N.Y.

[21] Appl. No.: 111,927

[22] Filed: Aug. 26, 1993

Related U.S. Application Data

[63] Continuation-in-part of Ser. No. 75,111, Jun. 11, 1993, abandoned.

[51] Int. Cl.[6] ..... E21B 37/00

[52] U.S. Cl. ..... 166/312; 210/710

[58] Field of Search ..... 166/312, 311, 166/50, 290; 175/65, 66; 210/710

[56] References Cited

U.S. PATENT DOCUMENTS

| | | | |
|---|---|---|---|
| 1,873,083 | 8/1932 | Walker . | |
| 2,429,593 | 10/1947 | Case . | |
| 2,546,586 | 3/1951 | Cross . | |
| 2,548,616 | 4/1951 | Priestman et al. | 255/4 |
| 2,567,009 | 9/1951 | Calhoun et al. | 166/1 |
| 3,116,781 | 1/1964 | Rugeley et al. | 153/54 |
| 3,182,877 | 5/1965 | Slator et al. | 226/172 |
| 3,285,485 | 11/1966 | Slator | 226/172 |
| 3,373,818 | 3/1968 | Rike et al. | 166/77 |
| 3,662,828 | 5/1972 | Hutchinson | 166/312 |
| 3,700,034 | 10/1972 | Hutchinson | 166/312 |
| 3,738,437 | 6/1973 | Scheuerman . | |
| 3,880,764 | 4/1975 | Donham | 1975/65 X |
| 3,884,302 | 5/1975 | Messenger . | |
| 4,127,174 | 11/1978 | Sharpe et al. . | |
| 4,284,140 | 8/1981 | Sydansk et al. . | |
| 4,321,968 | 3/1982 | Clear . | |
| 4,380,268 | 4/1983 | Martin . | |
| 4,442,899 | 9/1984 | Zublin | 166/312 |
| 4,451,377 | 5/1984 | Luxemburg | 210/708 |
| 4,476,930 | 10/1984 | Watanabe . | |
| 4,572,786 | 2/1986 | Endo . | |
| 4,592,425 | 6/1986 | Oliver, Jr. et al. | 166/312 |
| 4,599,117 | 6/1986 | Luxemburg | 134/25.1 |
| 4,694,901 | 9/1987 | Skinner | 166/312 X |
| 4,702,844 | 10/1987 | Flesher et al. . | |
| 4,741,838 | 5/1988 | Sharpe, Jr. | 210/710 |
| 4,765,913 | 8/1988 | Featherstone . | |
| 4,796,703 | 1/1989 | Gabel et al. | 166/312 |
| 4,856,590 | 8/1989 | Gaillier | 166/312 X |
| 4,909,325 | 3/1990 | Hopmann | 166/312 |
| 4,916,204 | 4/1990 | Baker et al. | 166/312 X |

OTHER PUBLICATIONS

"Pall Filtration Services for Completion, Workover, and Stimulation" Pall Well Technology, 1987, pp. 2–15.

"Versafloc Polymers Reduce Your Displacement Costs" Pall Well Technology, Mar. 1994, 29 pages total.

"Polymeric Flocculants Prove Most Effective Chemicals for Well–Bore Cleanup Operations" Holland et al., Soc. Petr. Eng. 1994.

"Versafloc™ Polymers Reduce Your Displacement Costs" Pall Well Technology Filtration Service Co., 1994, pp. 1–8.

Teel, M., editor, "World Oil's Coiled Tubing Handbook", Parts 1, 4, 8 and 13, Gulf Publishing Company (Houston, 1993).

*Primary Examiner*—Ramon S. Britts
*Assistant Examiner*—Frank S. Tsay
*Attorney, Agent, or Firm*—Leydig, Voit & Mayer

[57] ABSTRACT

An oil or gas well cleaning method includes inserting tubing, such as a coiled tubing, into a well bore, for example, into a production pipe in a well bore. A cleaning fluid containing a flocculant is passed into the well and the flocculant in the cleaning fluid is mixed with solid particles in the well bore to flocculate the particles. The cleaning fluid and the flocculated particles are then removed from the well. In one embodiment, the cleaning fluid containing the flocculant is discharged from the lower end of the tubing into the well, and the cleaning fluid with the flocculated particles is removed from the well via the production pipe. Alternatively, the cleaning fluid containing the flocculant may be introduced into the well through the production pipe, and the cleaning fluid with the flocculated particles may be removed via the tubing. The flocculant may also serve as a friction reducer to reduce friction between the cleaning fluid, the solids, the production pipe, and the tubing.

41 Claims, 1 Drawing Sheet

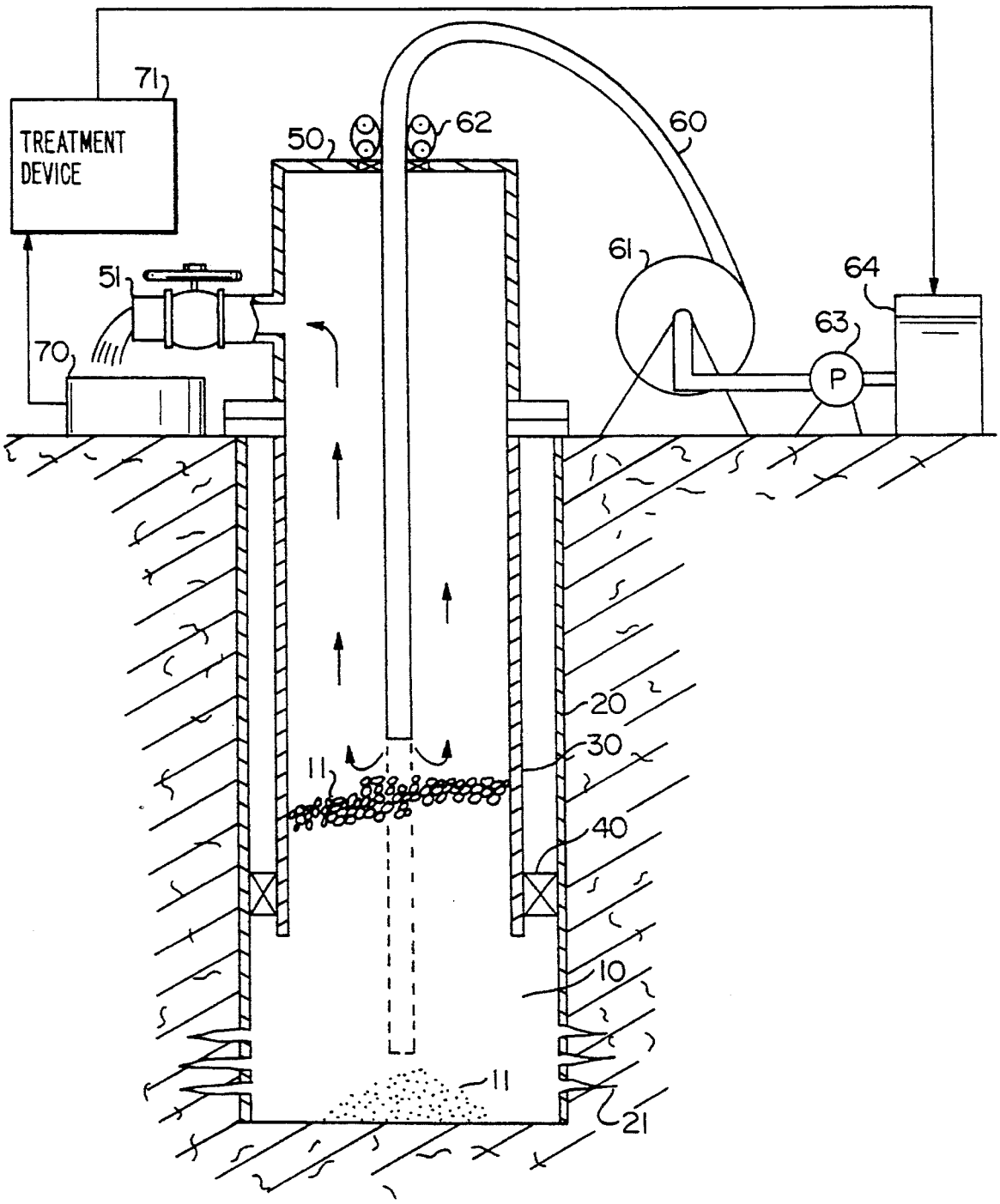
TREATMENT DEVICE
71
50
62
60
61
64
63
P
51
70
20
30
11
40
10
11
21

METHOD AND APPARATUS FOR OIL OR GAS WELL CLEANING

This application is a continuation-in-part application of U.S. application Ser. No. 08/075,111, filed Jun. 11, 1993, now abandoned.

FIELD OF THE INVENTION

This invention relates to a method and apparatus for cleaning wells for the production of oil or gas.

BACKGROUND OF THE INVENTION

An oil or gas well typically comprises a hole, called a well bore, which is drilled from the earth's surface or the sea floor to a level containing oil or gas. The well bore is frequently lined with pipes referred to as casing which reinforce the well bore. The casing in turn surrounds further pipes, referred to as production pipe, which is used to carry oil from inside the well bore to the earth's surface.

At various stages during drilling, completion, and/or workover of a well, there is a need to clean out the well bore and/or the production pipe. For example, after drilling, cementing, or perforating operations, a large amount of particulate matter removed from the sides of the well bore during these operations remains at the bottom of the well bore. Furthermore, during pumping operation of a well, sand and other particles may accumulate inside the production pipe and may partially or completely block fluid flow through the production pipe, thereby decreasing the efficiency of the well. Since the blockage may be thousands of feet beneath the earth, it is often uneconomical to pull the production pipe up to the surface to remove the blockage. Accordingly, there is a need for a method which can efficiently clean out an oil or gas well to remove particles from the bottom of the well bore and remove blockages of the production pipe without having to pull the production pipe out of the well.

SUMMARY OF THE INVENTION

Accordingly, it is an object of the present invention to provide a method for efficiently cleaning an oil or gas well to remove sand and other particles.

It is another object of the present invention to provide a cleaning apparatus for use in cleaning an oil or gas well.

In a method for cleaning an oil or gas well according to the present invention, tubing is inserted into a production pipe inside a well bore. A cleaning fluid containing a flocculant is passed through either the tubing or the production pipe, and the flocculant in the cleaning fluid is mixed with solid particles in the well to flocculate the particles. The cleaning fluid with the flocculated particles is then removed from the well through the other of the production pipe or the tubing. The flocculant may also serve as a friction reducer to reduce friction between the cleaning fluid, solids, production pipe, and tubing, thereby enhancing the efficiency of the cleaning operation.

In a preferred embodiment, a polymeric flocculant is added to the cleaning fluid. The cleaning fluid and the polymeric flocculant are passed through the tubing, discharged from the lower end of the tubing into the well bore, and removed from the well bore with the flocculated particles via the production pipe. Alternatively, the cleaning fluid may be introduced into the well bore via the production pipe, and the cleaning fluid with the flocculated particles may be removed from the well bore via the tubing.

An apparatus for cleaning an oil or gas well according to the present invention includes coiled tubing having a lower end inserted into a well bore, a source of cleaning fluid containing a polymeric flocculant, and a pumping apparatus for pumping the cleaning fluid from the source into the well. For example, the cleaning fluid may be pumped from the source through the coiled tubing and discharged from the lower end of the coiled tubing into the well bore, where the flocculant is mixed with solid particles in the well to flocculate the particles. The cleaning fluid with the flocculated particles may then be removed via the well bore. Alternatively, the cleaning fluid may be pumped into the well bore outside of the coiled tubing, and the cleaning fluid with the flocculated particles may be removed from the well via the coiled tubing.

The method and apparatus of the present invention can be used at various stages during the life of an oil or gas well. For example, it can be used to remove particles while during the drilling and completion stage, it can be used to clean out a completed well prior to the start of production, or it can be used to workover a well after the well has been operating for some length of time.

BRIEF DESCRIPTION OF THE DRAWINGS

The sole figure is a partially cross-sectional schematic elevation of an embodiment of a cleaning apparatus according to the present invention.

DESCRIPTION OF PREFERRED EMBODIMENTS

A cleaning method and apparatus according to the present invention will now be described while referring to the accompanying drawing of a preferred embodiment. This embodiment is applied to an oil well, but it can also be applied to a gas well. As shown in the figure, a completed oil well comprises a well bore 10 extending from the earth's surface or the sea floor to oil-producing strata. For simplicity, the well bore 10 is shown extending vertically, but the present invention is equally applicable to a well having a well bore extending horizontally or at an angle between the horizontal and vertical. The well bore 10 may be lined in a conventional manner with casing or oil string 20 (collectively referred to as casing) which reinforces the sides of the well bore 10. Perforations 21 are formed in the casing 20 near its lower end to permit oil to pass from the strata through the wall of the casing 20. A hollow production pipe 30 for bringing oil which collects inside the casing 20 to the earth's surface extends downward inside the casing 20 to a suitable depth. A sealing member called a packer 40 is disposed between the inner wall of the casing 20 and the outer wall of the production pipe 30 so that oil and other fluids will flow to the surface through the production pipe 30. A conventional well head 50 having a discharge pipe 51 is connected to the upper end of the production pipe 30 for controlling the outflow of fluids from the completed well.

Sand and other particles 11 can enter the well bore 10 via the perforations 21 in the casing 20 and accumulate at various locations within the well bore 10. For example, the particles 11 may accumulate at the bottom of the well bore 10, or they may accumulate within the production pipe 30 to form a so-called sand bridge which can impede fluid flow through the production pipe. In accordance with one aspect of the present invention, such particles 11 are removed from the well by introducing a cleaning fluid containing a flocculant, such as a polymeric flocculant, into the well to flocculate the particles and then removing the flocculated particles from the well together with the cleaning fluid.

The cleaning fluid comprises a mixture of a carrier fluid, which makes up the largest percentage by volume of the cleaning fluid, and a polymeric flocculant capable of flocculating sand and similar particles commonly found in an oil or gas well. The carrier fluid can be any liquid which is miscible with the flocculant and compatible with liquids typically present in an oil well. A few examples of suitable carrier fluids are aqueous fluids such as water, seawater, and brines containing a salt such as sodium chloride, calcium chloride, potassium chloride, ammonium chloride, sodium bromide, calcium bromide, or zinc bromide.

The polymeric flocculant is not limited to any particular type and may be any polymer which can perform flocculation in the carrier fluid. Polymers which have flocculating properties in aqueous solutions and which can be employed in the present invention include anionic and non-ionic polyacrylamides, polyethylene oxide, polyacrylic acid and its salts, polyamines, and the like. The flocculant can be selected in accordance with the nature of the carrier fluid. When the carrier fluid is sea water or a calcium brine, an example of a suitable polymeric flocculant is a mixture of anionic high molecular weight polyacrylamides with a molecular weight ranging between approximately 200,000 and approximately 2 million and a degree of hydrolysis of approximately 15% to approximately 40%. In a carrier fluid comprising a zinc brine, an example of a suitable polymeric flocculant is a non-ionic high molecular weight polyacrylamide with a molecular weight of approximately 200,000 to approximately 2 million.

The concentration of the polymeric flocculant in the cleaning fluid will typically be in the range of approximately 1 ppm to approximately 1000 ppm by volume and more preferably in the range of approximately 20 ppm to approximately 100 ppm by volume. If the concentration of the polymeric flocculant is too low, sufficient flocculation will not occur. On the other hand, an excessively high concentration of the polymeric flocculant is economically wasteful. To facilitate mixing the flocculant and the cleaning fluid, the flocculant is preferably premixed in a liquid. For example, the polymeric flocculant may be added to water, the concentration of the polymeric flocculant in the water being typically in the range from about ½% to about 1% by volume. The premixed flocculant solution may be added to the cleaning fluid.

The cleaning fluid may contain substances in addition to the carrier fluid and the flocculant, as long as these substances do not impair the performance of the flocculant. For example, the cleaning fluid may contain a conventional corrosion inhibitor such as commonly used in oil well workovers.

The cleaning fluid is preferably introduced into the well by means of relatively small diameter tubing 60, such as that generally known as coiled tubing. Use of coiled tubing is desirable because it allows the cleaning fluid to be introduced at a suitable location within the well with high efficiency. The coiled tubing 60 is usually stored on a rotatably supported reel 61 and is introduced into the well through the well head 50 by a feeding device 62, such as a tubing injector. The cleaning fluid is fed into the coiled tubing 50 by a pump 63 communicating with a supply of the cleaning fluid, such as a fluid reservoir 64. Coiled tubing units which include tubing, a reel, a feed device, and a pump and which can be readily installed on an existing well are commercially available from various manufacturers. An example of a unit suitable for use in the present invention is a Cymax-80 or Cymax-100 manufactured by Southwestern Pipe, Inc. of Houston, Tex. However, the coiled tubing 60 can be introduced into the well by any other suitable device.

Coiled tubing is commercially available in sizes ranging from 0.75 in. OD up to 3.5 in. OD. However, the size of the coiled tubing used in the present invention is not critical, and sizes outside this range can also be used. The choice of the size of the coiled tubing will depend on factors such as inner diameter of the production pipe 30, the pressure within the well, the depth of the well, and other well characteristics.

The coiled tubing 60 can be inserted into the well by the feed device 62 until the lower end of the coiled tubing 60 is at a desired depth. For example, when it is desired to remove a sand bridge from inside the production pipe 30, the coiled tubing can be lowered to the vicinity of the sand bridge, as shown by solid lines in the figure. When it is desired to remove particles accumulated at the bottom of the well bore 10 or to clean out the perforations 21, the coiled tubing 60 can be lowered to the vicinity of the bottom of the well bore 10, as shown by the dashed lines. Depending on the oil well, this location may be a thousand or more feet below the lower end of the production pipe 30.

The rate of discharge of the cleaning fluid from the bottom of the coiled tubing 60 into the well is not critical but is preferably high enough that a turbulent flow regime exists within the production pipe 30 between the lower end of the coiled tubing 60 and the well head 50. Turbulence increases the ability of the cleaning fluid to dislodge particulate solids from inside the well and to keep the particulate solids suspended in the cleaning fluid until it is discharged at the well head 50. Typically, the cleaning fluid will be passed through the coiled tubing 60 at rate of from approximately 20 to approximately 100 gallons per minute, but rates outside of this range can also be used.

The temperature of the cleaning fluid during cleaning operation is not critical, but is preferably below the temperature at which the polymeric flocculant degrades.

When the cleaning fluid is discharged from the coiled tubing 60 in the vicinity of particles in the well, clumps of the particles are broken down into smaller pieces, and the fluid within the well is agitated so that the individual particles can come into contact with the polymeric flocculant in the cleaning fluid. The flocculant forms the particles into aggregates in which strong bridges exist between particles due to simultaneous adsorption of the flocculant on a plurality of the particles. The aggregates, called flocs, are typically several orders of magnitude larger than the individual particles. The flocs are entrained in the cleaning fluid and swept up the production pipe 30 with the cleaning fluid to the top of the well.

The drag force acting on an aggregate suspended in the cleaning fluid increases with the square of the aggregate size, and an increased drag force increases the sweeping efficiency of the cleaning fluid, i.e., the ability of the cleaning fluid to remove particles from the well. Therefore, the larger the size of the aggregates, the more efficiently can well cleaning be performed. It has been found that under turbulent flow conditions such as generally exist during oil well cleaning, a polymeric flocculant has the ability to form particles into larger aggregates than can be achieved than when using other substances for producing aggregation, such as surfactants. This is thought to be because in an aggregate of particles formed by a surfactant, the forces between particles are much weaker than in an aggregate formed by a flocculant. Therefore, an aggregate formed by a surfactant is more likely to be broken up by the forces acting on it during turbulent flow and so can not achieve as large a size as an aggregate formed by flocculation.

Another advantage of using a flocculant in the cleaning fluid is that flocculants, especially higher molecular weight flocculants, act as friction reducers or lubricants and reduce the friction between the cleaning fluid, the solids, the casing, the production pipe, and/or the tubing. This allows larger fluid volumes to be passed through smaller spaces and increases the flow rate of the cleaning fluid, reducing the cleaning time as well as increasing the effectiveness of cleaning.

Upon reaching the top of the well bore 10, the cleaning fluid is discharged from a discharge pipe 51 of the well head 50 and then either reclaimed for reuse or disposed of in a suitable manner in accordance with environmental regulations. For example, in the illustrated embodiment, the cleaning fluid is collected in a tank 70 and then passed through any suitable fluid treatment device 71 to remove the flocs or other undesirable substances from the cleaning fluid. The fluid which is discharged from the fluid treatment device 71 is suitable for reuse in cleaning the well and can be returned to the reservoir 64 for cleaning fluid. Various conventional processes can be performed by the fluid treatment device 71 to treat the-cleaning fluid. For example, flocs can be removed from the cleaning fluid by settling and/or filtration to obtain particulate solids by a method such as that described in U.S. Pat. No. 4,599,117, for example. Particulate solids obtained by the fluid treatment device 71 can be safely discharged to the environment.

In the illustrated embodiment, cleaning fluid containing a flocculant is pumped or circulated from the reservoir 64 through the coiled tubing 60 and discharged from the end of the coiled tubing 60 into the well bore 10. The flocculant then flocculates the solids and the cleaning fluid with the flocculated solids is returned to the well head 50 via the production pipe 30. Alternatively, a reverse direction pumping or circulation may be used in which the cleaning fluid containing the flocculant is introduced into the well via the production pipe 30 and the cleaning fluid with the flocculated solids is returned to the well head 50 via the coiled tubing 60.

The volume of cleaning fluid which is circulated through the well will depend upon the size of the well and the amount of particles present in the well. Typically, at least one well volume (the volume of liquid inside the production pipe 30 from the lower end of the coiled tubing 60 up to the well head 50) of the cleaning fluid will be passed through the coiled tubing 60 during cleaning. The progress of cleaning by the cleaning fluid can be determined by monitoring the turbidity of the cleaning fluid discharged from the well head 50. The turbidity will vary in accordance with the amount of particles being removed from the well by the cleaning fluid. When the turbidity of the discharged cleaning fluid decreases to a substantially constant level, most of the particles 11 removable from the well by the cleaning fluid will have been removed, and at this point, circulation of the cleaning fluid may be terminated, since additional circulation will not produce a substantial further benefit.

Cleaning a completed well with a cleaning fluid containing a flocculant can be combined with other conventional well cleaning procedures. For example, prior to introducing the cleaning fluid into the well, it may be desirable to pickle the coiled tubing 60 with a volume of hydrochloric acid mixed with a corrosion inhibitor to remove rust, scale, and other debris. The acid can then be displaced with a caustic pill, such as sodium hydroxide, for neutralization. In addition, before circulating the cleaning fluid through the well, it may be desirable to introduce a viscous pill of a material such as hydroxyethylcellulose. Each of these materials can be introduced through the coiled tubing 60. Water or seawater can also be circulated through the well bore to perform further cleaning after introduction of the cleaning fluid.

The present invention is particularly suitable for use in workovers of completed wells, but it can also be used at other stages during the construction or operation of a well. For example, the coiled tubing could be inserted into a production pipe before installation of a packer to flush out the annulus between the production pipe and casing surrounding the production pipe using a flocculant-containing cleaning fluid. Alternatively, the coiled tubing could be inserted into the annulus between the production pipe and the casing to clean out the annulus with the flocculant-containing cleaning fluid. In addition, the coiled tubing could be inserted into the casing before the production pipe has been installed to clean out the casing with the flocculant-containing cleaning fluid, or it could be used to clean out the well bore even before installation of the casing.

What is claimed is:

1. An oil or gas well cleaning method comprising:

inserting tubing having a lower end into a pipe within an oil or gas well bore;

passing a cleaning fluid containing a polymeric flocculant through one of the tubing and the pipe;

mixing the cleaning fluid with solid particles in the well bore to flocculate the particles; and removing the cleaning fluid and the flocculated particles from the well bore through the other of the tubing and the pipe.

2. The method as claimed in claim 1 wherein passing the cleaning fluid through one of the tubing and the pipe includes discharging the cleaning fluid from the lower end of the tubing within the well bore.

3. A method as claimed in claim 2 wherein discharging the cleaning fluid from the tubing includes discharging the cleaning fluid at a rate sufficient to create a turbulent flow regime in the well bore.

4. A method as claimed in claim 1 wherein the flocculant comprises a friction reducer.

5. A method as claimed in claim 1 wherein the flocculant is an anionic or non-ionic polyacrylamide.

6. A method as claimed in claim 1 wherein the cleaning fluid includes a carrier fluid.

7. A method as claimed in claim 6 wherein the carrier is an aqueous fluid.

8. A method as claimed in claim 7 wherein the carrier comprises a brine.

9. A method as claimed in claim 1 wherein the concentration of the flocculant in the cleaning fluid is approximately 1 ppm to approximately 100 ppm by volume.

10. A method as claimed in claim 9 wherein the concentration of the flocculant in the cleaning fluid is approximately 20 ppm to approximately 100 ppm by volume.

11. A method as claimed in claim 1 wherein the fluid is passed through coiled tubing.

12. A method as claimed in claim 1 further comprising separating the flocculated particles from the cleaning fluid after removing the cleaning fluid from the well bore and reusing the cleaning fluid.

13. The method as claimed in claim 1 wherein the flocculant comprises a polyacrylamide with a molecular weight ranging between approximately 200,000 and approximately 2 million.

14. The method as claimed in claim 13 wherein the concentration of the flocculant in the cleaning fluid is approximately 20 ppm to approximately 100 ppm by volume.

15. The method as claimed in claim 13 wherein the cleaning fluid contains a carrier fluid comprising sea water or calcium brine, and the polyacrylamide comprises an anionic polyacrylamide.

16. The method as claimed in claim 15 wherein the polyacrylamide has a degree of hydrolysis of approximately 15% to approximately 40%.

17. The method as claimed in claim 13 wherein the cleaning fluid contains a carrier fluid comprising a zinc brine, and the polyacrylamide comprises a non-ionic polyacrylamide.

18. A method as claimed in claim 1 wherein the pipe comprises a production pipe disposed within the well bore.

19. An oil or gas well cleaning method comprising:

inserting coiled tubing having a lower end into an oil or gas well bore;

passing a cleaning fluid containing a polymeric flocculant through one of the tubing and the interior of the well bore surrounding the tubing;

mixing the cleaning fluid with solid particles in the well bore to flocculate the particles; and removing the cleaning fluid and the flocculated particles through the other of the tubing and the interior of the well bore surrounding the tubing.

20. The method as claimed in claim 19 including introducing the cleaning fluid into the well through the coiled tubing and removing the cleaning fluid and the flocculated particles through a pipe surrounding the coiled tubing.

21. The method as claimed in claim 20 comprising removing the cleaning fluid and the flocculated particles through production pipe surrounding the coiled tubing.

22. An oil or gas well cleaning apparatus comprising:

coiled tubing having a lower end disposed inside a well bore of an oil or gas well;

a source of a cleaning fluid containing a polymeric flocculant; and a pump arranged to pump the cleaning fluid from the source into the well via one of the tubing and the well bore.

23. An apparatus as claimed in claim 22 wherein the pump discharges the cleaning fluid containing the flocculant from the lower end of the coiled tubing into the well.

24. An apparatus as claimed in claim 23 wherein the pump discharges the cleaning fluid from the coiled tubing at a rate sufficient to create a turbulent flow regime in the well bore.

25. An apparatus as claimed in claim 23 wherein the pump causes the cleaning fluid to be discharged from an upper end of the well bore after being discharged from the coiled tubing.

26. An apparatus as claimed in claim 22 further comprising separating means for separating flocculated particles from the cleaning fluid discharged from an upper end of the well and reintroducing the cleaning fluid into the well.

27. The apparatus as claimed in claim 22 wherein the flocculant comprises a polyacrylamide with a molecular weight ranging between approximately 200,000 and approximately 2 million.

28. The apparatus as claimed in claim 27 wherein the concentration of the flocculant in the cleaning fluid is approximately 20 ppm to approximately 100 ppm by volume.

29. The apparatus as claimed in claim 27 wherein the cleaning fluid contains a carrier fluid comprising sea water or calcium brine, and the polyacrylamide comprises an anionic polyacrylamide.

30. The apparatus as claimed in claim 29 wherein the polyacrylamide has a degree of hydrolysis of approximately 15% to approximately 40%.

31. The apparatus as claimed in claim 27 wherein the cleaning fluid contains a carrier fluid comprising a zinc brine, and the polyacrylamide comprises a non-ionic polyacrylamide.

32. An oil or gas well cleaning method comprising:

inserting coiled tubing into a pipe of an oil or gas well bore;

introducing a cleaning fluid containing a polymeric flocculant into the well bore through the tubing;

mixing the cleaning fluid with solid particles in the well bore to flocculate the particles; and removing the cleaning fluid and the flocculated particles from the well bore through the pipe.

33. The method as claimed in claim 32 wherein the flocculant comprises a polyacrylamide with a molecular weight ranging between approximately 200,000 and approximately 2 million.

34. The method as claimed in claim 33 wherein the concentration of the flocculant in the cleaning fluid is approximately 20 ppm to approximately 100 ppm by volume.

35. The method as claimed in claim 33 wherein the cleaning fluid contains a carrier fluid comprising sea water or calcium brine, and the polyacrylamide comprises an anionic polyacrylamide.

36. The method as claimed in claim 35 wherein the polyacrylamide has a degree of hydrolysis of approximately 15% to approximately 40%.

37. The method as claimed in claim 33 wherein the cleaning fluid contains a carrier fluid comprising a zinc brine, and the polyacrylamide comprises a non-ionic polyacrylamide.

38. The method as claimed in claim 32 including introducing the cleaning fluid through an open lower end of an axial bore of the tubing.

39. The method as claimed in claim 38 including introducing the cleaning fluid in a vicinity of a sand bridge formed across the pipe.

40. A method of removing a sand bridge from an oil or gas well comprising:

inserting coiled tubing having an axial bore with an open lower end into a pipe of an oil or gas well bore to a vicinity of a sand bridge formed in the pipe;

introducing a cleaning fluid containing a polymeric flocculant into the well bore through the lower end of the bore of the tubing;

mixing the cleaning fluid with solid particles in the sand bridge to flocculate the particles; and removing the cleaning fluid and the flocculated particles from the well bore through the pipe.

41. The method as claimed in claim 40 wherein the pipe comprises production pipe.

* * * * *